US008690639B2

(12) United States Patent
Yajima

(10) Patent No.: US 8,690,639 B2
(45) Date of Patent: Apr. 8, 2014

(54) METHOD OF MANUFACTURING EYEGLASS LENS

(75) Inventor: Eiichi Yajima, Shinjuku-ku (JP)

(73) Assignee: Hoya Corporation, Tokyo (JP)

( * ) Notice: Subject to any disclaimer, the term of this patent is extended or adjusted under 35 U.S.C. 154(b) by 218 days.

(21) Appl. No.: 13/401,455

(22) Filed: Feb. 21, 2012

(65) Prior Publication Data

US 2013/0052918 A1 Feb. 28, 2013

(30) Foreign Application Priority Data

Feb. 21, 2011 (JP) ..... 2011-034791
Feb. 20, 2012 (JP) ..... 2012-33919

(51) Int. Cl.
*B24B 1/00* (2006.01)

(52) U.S. Cl.
USPC ..... 451/42; 451/384; 451/389; 451/390; 264/1.32

(58) Field of Classification Search
USPC ..... 451/42, 384, 389, 390; 264/1.32, 1.7, 264/2.7
See application file for complete search history.

(56) References Cited

U.S. PATENT DOCUMENTS

RE24,906 E * 12/1960 Ulrich ..... 526/328.5
4,221,083 A * 9/1980 Carroll ..... 451/42
4,498,919 A * 2/1985 Mann ..... 65/30.11
5,380,387 A * 1/1995 Salamon et al. ..... 156/154
5,472,797 A * 12/1995 Yajima et al. ..... 428/688
5,827,390 A * 10/1998 Benjamin et al. ..... 156/245
5,885,700 A * 3/1999 Weldon et al. ..... 428/212
5,916,017 A * 6/1999 Sedlock ..... 451/460
6,191,884 B1 * 2/2001 Takizawa et al. ..... 359/359
6,505,942 B2 * 1/2003 Ohishi et al. ..... 359/601
6,932,678 B2 * 8/2005 Toyoshima et al. ..... 451/42
6,942,746 B2 * 9/2005 Niejelow et al. ..... 156/154
7,144,305 B2 * 12/2006 Toyoshima et al. ..... 451/44
7,189,148 B2 * 3/2007 Toyoshima et al. ..... 451/42
7,500,903 B2 * 3/2009 Toyoshima et al. ..... 451/42
7,547,357 B2 * 6/2009 Sanbayashi et al. ..... 106/287.17
7,782,537 B2 * 8/2010 Naito et al. ..... 359/642
7,935,402 B2 * 5/2011 Cole et al. ..... 428/40.1
8,177,607 B2 * 5/2012 Herbin et al. ..... 451/384
8,268,907 B2 * 9/2012 Valeri ..... 522/79
2003/0129925 A1 * 7/2003 Toyoshima et al. ..... 451/5
2007/0084381 A1 * 4/2007 Sanbayashi et al. ..... 106/287.17
2007/0195259 A1 * 8/2007 Olsson ..... 351/43
2008/0274672 A1 * 11/2008 Cole et al. ..... 451/41
2009/0053516 A1 * 2/2009 Davidovits et al. ..... 428/339
2009/0239043 A1 * 9/2009 Kondos et al. ..... 428/195.1
2009/0311518 A1 * 12/2009 Valeri ..... 428/336
2010/0304120 A1 * 12/2010 Tokudome et al. ..... 428/304.4
2011/0304065 A1 * 12/2011 Wang ..... 264/2.7

* cited by examiner

*Primary Examiner* — George Nguyen
(74) *Attorney, Agent, or Firm* — Sughrue Mion, PLLC

(57) ABSTRACT

An aspect of the present invention relates to a method of manufacturing an eyeglass lens, which comprises a step of conducting polishing processing of a non-optical surface of a semifinished lens, one surface of which is an optical surface and the other surface of which is the non-optical surface, to create an optical surface. The semifinished lens comprises an acrylic coating on an optical surface of a lens substrate, a surface of the acrylic coating having a contact angle relative to water of equal to or less than 90°, prior to the polishing processing, a protective film is adhered through an adhesive layer of the film to the surface of the acrylic coating, and the polishing processing is conducted by polishing a non-optical surface of the lens substrate in a state where the protective film surface is secured in a block jig.

5 Claims, 7 Drawing Sheets

METHOD OF MANUFACTURING EYEGLASS LENS

CROSS-REFERENCE TO RELATED APPLICATIONS

This application claims the benefit of priority under 35 USC 119 to Japanese Patent Application No. 2011-034791 filed on Feb. 21, 2011 and Japanese Patent Application No. 2012-33919 filed on Feb. 20, 2012, which are expressly incorporated herein by reference in their entirety.

BACKGROUND OF THE INVENTION

1. Field of the Invention

The present invention relates to a method of manufacturing an eyeglass lens, and more particularly, to a method of manufacturing an eyeglass lens comprising the step of creating an optical surface by polishing a non-optical surface of a semifinished lens.

2. Discussion of the Background

In the process of manufacturing an eyeglass lens, mass producing and storing a lens that is thicker than the finished dimension (a semifinished lens), and, when an order is received, finishing a product lens (a finished lens) having the desired optical characteristics based on the needs of the user is widely practiced. Usually, on a surface on the object side of the semifinished lens, a mold surface is transferred during casting polymerization to finish an optical surface. Additionally, on a surface on the eye side (concave surface), mechanical processing (grinding or cutting) is used to process a desired surface shape based on a lens prescription. However, when that is done, traces due to mechanical processing remain on the concave surface. Thus, use as an optical lens is precluded. Accordingly, polishing processing is usually conducted after the mechanical processing. This polishing processing makes it possible to obtain a finished lens with desired finished optical surfaces on both sides. Normally, a scratch-preventing protective film is adhered to the optical surface side in advance and this polishing processing is conducted in a state where the protective film surface is secured in a block jig (for example, see Japanese Unexamined Patent Publication (KOKAI) No. 2008-183714 and Japanese Patent No. 4084081 or English language family members US2003/129925A1, U.S. Pat. No. 6,932,678, US2005/227592A1, U.S. Pat. No. 7,144,305, US2006/073770A1, U.S. Pat. No. 7,189,148, US2007/202778A1, U.S. Pat. No. 7,500,903, which are expressly incorporated herein by reference in their entirety).

Conventional semifinished lenses are generally uncoated lenses without coatings on the optical surface side. By contrast, semifinished lenses with an optical surface on which a functional film has been formed have been manufactured in recent years. This has been done because, by forming a functional film, it is possible to prevent scratching and the adhesion of foreign matter to the optical surface during processing, as well as to prevent corrosion due to moisture and oxygen in the atmosphere. Further, when a functional film is previously formed on a lens that is in a semifinished state, there is no need to form the functional film upon receipt of an order. This is advantageous for reducing the time elapsing between the receipt of an order and shipment of the finished lens.

However, when the present inventor polished the non-optical surface of the semifinished lens on which a functional film had been applied, he determined that the lens could not be adequately secured during polishing, and that it was sometimes difficult to conduct polishing processing. When the present inventor conducted further research in this regard, they found that there was inadequate adhesion between the protective film and the functional film, and that an inability to withstand the load during polishing processing was why the lens could not be adequately secured during polishing.

SUMMARY OF THE INVENTION

An aspect of the present invention provides for a means for manufacturing with high productivity an eyeglass lens from a semifinished lens having a functional film.

The present inventor conducted extensive research, resulting in the discovery that improper securing during polishing tended to occur frequently with semifinished lenses having a functional film in the form of an acrylic coating. Accordingly, the present inventor conducted further extensive research into the adhesion between the acrylic coating surface and the protective film. That research resulted in the discovery that by controlling the contact angle of the acrylic coating surface (surface of adhesion) relative to water to equal to or less than 90°, it was possible to avoid securing failure during polishing. The present inventor attributed this to the fact that heightening the hydrophilic property of the acrylic coating contributed to enhancing adhesion between the protective film and the adhesive layer.

The present invention was devised on the basis of the above discoveries.

An aspect of the present invention relates to a method of manufacturing an eyeglass lens, which comprises a step of conducting polishing processing of a non-optical surface of a semifinished lens, one surface of which is an optical surface and the other surface of which is the non-optical surface, to create an optical surface, wherein the semifinished lens comprises an acrylic coating on an optical surface of a lens substrate, a surface of the acrylic coating having a contact angle relative to water of equal to or less than 90°, prior to the polishing processing, adhering a protective film through an adhesive layer of the film to the surface of the acrylic coating, and conducting the polishing processing by polishing a non-optical surface of the lens substrate in a state where the protective film surface is secured in a block jig.

The acrylic coating may be a coating layer formed by curing a coating film containing an acrylate compound and inorganic oxide particles.

The inorganic oxide particles may be silica colloidal particles.

The adhesive layer may be comprised of acrylic adhesive.

The semifinished lens may comprise a polarizing layer between the lens substrate and the acrylic coating.

The present invention makes it possible to finish a non-optical surface of a semifinished lens on which an acrylic coating has been formed into an optical surface by polishing in a stably secured state.

DETAILED DESCRIPTION OF THE EMBODIMENTS

Figure 1:
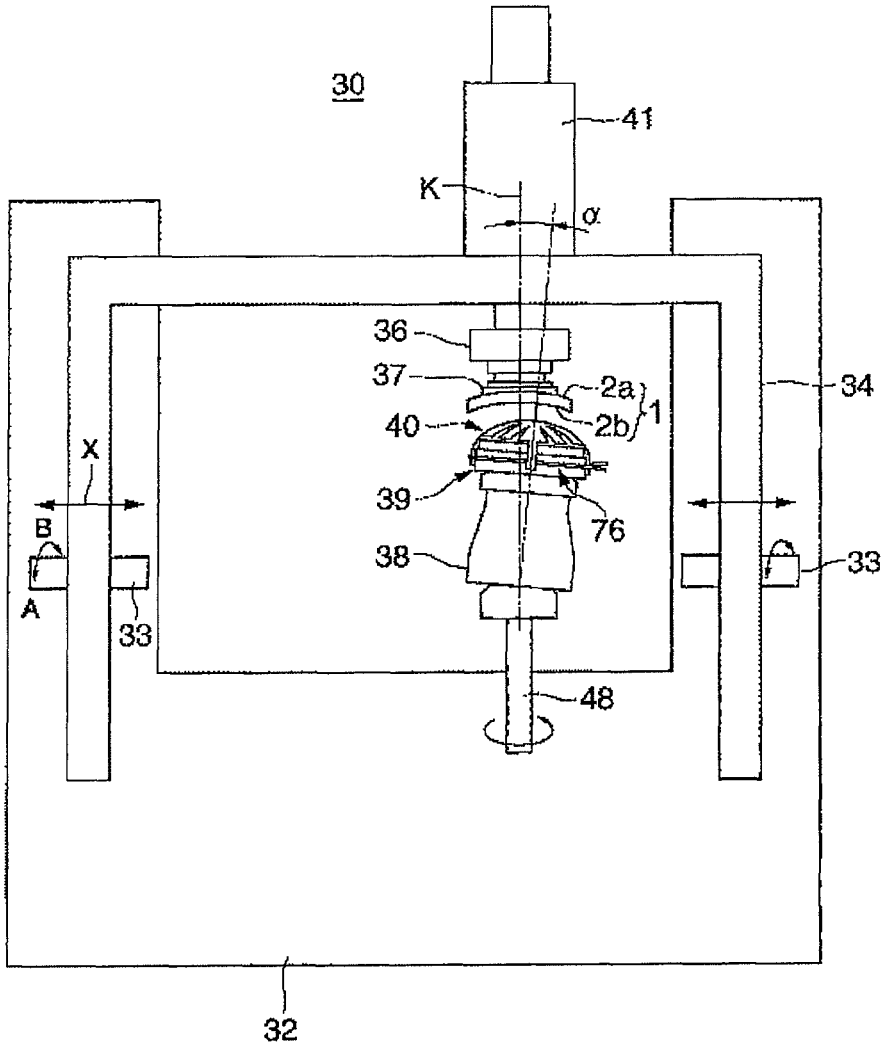
FIG. 1 is a schematic structural diagram of a polishing device that can be employed in the present invention.

An aspect of the present invention relates to a method of manufacturing an eyeglass lens comprising a step of conducting polishing processing of a non-optical surface of a semifinished lens, one surface of which is an optical surface and the other surface of which is the non-optical surface, to create an optical surface. The semifinished lens comprises an acrylic coating on an optical surface of a lens substrate. Prior to the polishing processing, a protective film is adhered through an adhesive layer of the film to the surface of the acrylic coating. The polishing processing is conducted by polishing a non-optical surface of the lens substrate in a state where the protective film surface is secured in a block jig. However, when the contact angle relative to water of the acrylic coating surface that is the surface to which the adhesive layer of the protective film adheres exceeds 90°, adhesion between the protective film and the acrylic coating is inadequate. Thus, during polishing, the semifinished lens cannot be stably secured to the block jig and polishing ends up failing. Accordingly, in the present invention, the contact angle relative to water of the acrylic coating surface to which the adhesive layer of the protective film adheres is specified as equal to or less than 90°. To more stably secure the semifinished lens during polishing, the contact angle is desirably equal to or less than 70°, preferably equal to or less than 65°. In the present invention, the contact angle relative to water refers to a value that is measured in a measurement environment of a temperature of 20 to 25° C. and a humidity of 30 to 60% RH.

The smaller the contact angle relative to water of the acrylic coating surface, the greater the adhesion between the protective film and the acrylic coating. The greater the adhesion, the more necessary it becomes to apply a powerful force to separate and remove the protective film. Further, the adhesive of the protective film sometimes also remains on the acrylic coating surface after separation and removal. Thus, from the perspective of operability in the course of separating and removing the protective film after polishing, the contact angle is desirably equal to or greater than 40°, preferably equal to or greater than 50°. However, to further reduce polishing failure, a low contact angle is desirable. Thus, there is no specific lower limit.

In the present invention, the term "acrylic coating" refers to a coating layer obtained by curing a coating film containing an acrylate compound. In the present invention, the term "acrylic coating" includes the methacrylic coating, and the term "acrylate compound" includes the methacrylate compound. The term "(meth)acrylate" as employed below is to be construed as including both the acrylate and the methacrylate compounds.

Acrylate compounds are desirably compounds having an acryloyloxy group or methacryloyloxy group, preferably polyfunctional acrylate compounds having at least two acryloyloxy groups or methacryloyloxy groups in the molecule. Polyfunctional acrylate groups can form high-strength coatings by forming crosslinked structures. Thus, during polishing, or in steps before or after polishing, they can function as hard coat layers to protect the outermost surface on the optical surface side of the semifinished lens. Further, following processing into a finished lens, they can contribute to enhancing the impact resistance and scratch resistance of the lens.

Specific examples of the acrylate compound employed for forming the acrylic coating are ethyleneglycol diacrylate, diethyleneglycol diacrylate, 1,6-hexanediol diacrylate, neopentylglycol diacrylate, trimethylolpropane triacrylate, trimethylolethane triacrylate, tetramethylolmethane triacrylate, tetramethylolmethane tetraacrylate, pentaglycerol triacrylate, pentaerythritol triacrylate, pentaerythritol tetraacrylate, glycerin triacrylate, dipentaerythritol triacrylate, dipentaerythritol tetraacrylate, dipentaerythritol pentaacrylate, dipentaerythritol hexaacrylate, tris(acryloyloxyethyl)isocyanurate, ethyleneglycol dimethacrylate, diethyleneglycol dimethacrylate, 1,6-hexanediol dimethacrylate, neopentylglycol dimethacrylate, trimethylolpropane trimethacrylate, trimethylolethane trimethacrylate, tetramethylolmethane trimethacrylate, tetramethylolmethane tetramethacrylate, pentaglycerol trimethacrylate, pentaerythritol trimethacrylate, pentaerythritol tetramethacrylate, glycerin trimethacrylate, dipentaerythritol trimethacrylate, dipentaerythritol tetramethacrylate, dipentaerythritol pentamethacrylate, dipentaerythritol hexamethacrylate, tris(methacryloyloxyethyl)isocyanurate, a phosphazene-based acrylate compound or phosphazene-based methacrylate compound in which an acryloyloxy group or methacryloyloxy group has been introduced onto the phosphazene ring of a phosphazene compound; a urethane acrylate compound or urethane methacrylate compound obtained by reacting a polyisocyanate having at least two isocyanate groups in the molecule with a polyol compound having at least one acryloyloxy group or methacryloyloxy group and a hydroxyl group; a polyester acrylate compound or polyester methacrylate compound, obtained by reacting with polyol compound having at least two carboxylic acid halides per molecule as well as at least one acryloyloxy group or methacryloyloxy group and a hydroxyl group; and dimers, trimers, and other oligomers and the like of the above compounds. In addition, fluorine-containing acrylate compounds can be contained. The compound of formula (I) described in Japanese Unexamined Patent Publication (KOKAI) No. 2011-32352, which is expressly incorporated herein by reference in its entirety, is a specific example of a fluorine-containing acrylate compound. Reference can be made to that publication for details.

These compounds can be employed singly or in combinations of two or more. In addition to the above polyfunctional (meth)acrylates, at least one monofunctional (meth)acrylate selected from the group consisting of hydroxyethyl (meth) acrylate, 2-hydroxyethyl (meth)acrylate, 2-hydroxypropyl (meth)acrylate, hydroxybutyl (meth)acrylate, 2-hydroxy-3-phenoxypropyl (meth)acrylate, and glycidyl (meth)acrylate can be compounded, desirably in a proportion of equal to or less than 10.0 mass percent relative to the solid component during curing of the coating material composition for forming the acrylic coating.

A polymerizable oligomer can be added to the coating material composition to adjust the hardness of the acrylic coating that is formed. Examples of such oligomers are terminal (meth)acrylate polymethylmethacrylate, terminal styryl poly(meth)acrylate, terminal (meth)acrylate polystyrene, terminal (meth)acrylate polyethyleneglycol, terminal (meth)acrylate acrylonitrile-styrene copolymers, terminal (meth)acrylate styrene-methyl (meth)acrylate copolymers, and other macromonomers. The content thereof is desirably 5.0 to 50.0 mass percent relative to the solid component during curing of the coating material composition.

The above polymerizable component can be employed as a solution in which it is mixed with a solvent. Commercially available polymerizable components can also be employed. Specific examples of commercially available compounds are: "NK Hard M101" (a urethane acrylate compound made by Shin-Nakamura Chemical Co., Ltd.); "NK Ester A-TMM-3L" (tetramethylolmethane triacrylate made by Shin-Nakamura Chemical Co., Ltd.); "NK Ester A-9530" (dipentaerythritol hexaacrylate made by Shin-Nakamura Chemical Co., Ltd.); "Kayarad (registered trademark) DPHA series" (a dipentaerythritol hexaacrylate compound made by Nippon Kayaku Co., Ltd.); "Kayarad (registered trademark) DPCA series" (a derivative of a dipentaerythritol hexaacrylate compound made by Nippon Kayaku Co., Ltd.); "Aronix (registered trademark) M-8560" (a polyester acrylate compound made by Toagosei Co., Ltd.); "New Frontier (registered trademark) TEICA" (tris(acryloyloxyethyl)isocyanurate made by Dai-ichi Kogyo Seiyaku Co., Ltd.); and "PPZ" (a phosphazene-based methacrylate compound made by Kyoeisha Chemical Co., Ltd.). The coating material composition for forming an acrylic coating can also contain various additives such as known photopolymerization initiators and leveling agents. As an example, a fluorine-containing compound such as the compound described in paragraph [0064] of Japanese Unexamined Patent Publication (KOKAI) No. 2011-32352 can be employed as a leveling agent. However, the types and quantities of the various additives such as photopolymerization initiators and leveling agents are not specifically limited and can be suitably established.

To impart a hydrophilic property to the acrylic coating and keep the contact angle of the surface relative to water to equal to or less than 90°, it suffices to add a component that contributes to enhancing hydrophilicity to the coating material composition for forming the acrylic coating. Inorganic oxide particles are an example of such components. Examples of inorganic oxide particles that are desirable from the perspective of enhancing hydrophilicity are inorganic oxide particles such as silica, zirconia, alumina, and alumina-magnesium complex oxides. From the perspective of achieving both scratch resistance and optical characteristics, the particle diameter of the inorganic oxide particles desirably falls within a range of 5 to 30 mm. The quantity of inorganic oxide particles that are added to the coating material composition for forming the acrylic coating need simply be set within the range that permits controlling the contact angle of the surface of the acrylic coating to within the desired range. Normally, it is about 5 to 80 weight % based on the solid component of the coating material composition. From the perspective of dispersion in the acrylic coating, the inorganic oxide particles are desirably colloidal particles. Since numerous hydrophilic groups in the form of OH groups are present on the surface of the particles, it is particularly desirable to add silica colloidal particles as a hydrophilic property-enhancing component.

The components employed in the coating material composition are normally diluted with solvent for use. The solvent employed can be suitably selected from among aliphatic hydrocarbons such as hexane and octane; aromatic hydrocarbons such as toluene and xylene; alcohols such as ethanol, 1-propanol, isopropanol, and 1-butanol; ketones such as methyl ethyl ketone and methyl isobutyl ketone; esters such as ethyl acetate and butyl acetate; and cellosolves. Several of these organic solvents can be mixed together for use as needed. The type and quantity of solvent employed is suitably selected based on the type and quantity of components employed, the coating method, the coating thickness being targeted, and the like.

The coating material composition for forming the acrylic coating is directly applied on the optical surface of the semifinished lens, or indirectly applied through the intermediary of another layer. It is then dried as needed, and the coating film that has been formed is subjected to a curing treatment to form an acrylic coating on the outermost surface on the optical surface side of the semifinished lens. A known coating method such as dipping or spin coating can be employed to apply the coating. It suffices to suitably set the coating conditions in a manner permitting the formation of an acrylic coating of desired thickness. Curing is normally conducted by irradiation with light. The light that is irradiated is, for example, an electron beam or ultraviolet radiation. The type of light that is irradiated and the irradiation conditions are suitably selected based on the type of polymerizable component employed. From the perspective of resistance to scratching, the thickness of the acrylic coating that is formed is desirably about 0.5 to 10 μm.

Alternatively, the acrylic coating can be a photochromic layer having a photochromic property. In that case, a photochromic dye and the various additives that are normally added to a photochromic layer are contained in the acrylic coating. Reference can be made to paragraphs [0076] to [0097] and the like of WO 2008/001578A1, which is expressly incorporated herein by reference in its entirety, for details on photochromic dyes and additives. When the acrylic coating is a photochromic layer, the thickness thereof is desirably equal to or greater than 10 μm, preferably 20 to 60 μm, from the perspective of achieving good photochromic characteristics.

The lens substrate of the semifinished lens having the acrylic coating set forth above is not specifically limited. Examples are the various resins commonly employed in plastic lenses, such as urethane, epithio, and polycarbonate resins, and diethylene glycol bis-allyl carbonate (CR39). Between the lens substrate and the acrylic coating, any one or more functional films can be optionally formed. For example, since semifinished lenses having a polarizing layer on an optical surface can be shipped as a finished lens (polarizing lens) as is following polishing processing, these lenses are desirable to shorten the time between receipt of orders and shipment. In the present invention, any known method can be applied without limitation to form a polarizing layer. For example, reference can be made to Published Japanese Translation (TOKUHYO) No. 2008-527401 of a PCT International Application; Japanese Unexamined Patent Publication (KOKAI) No. 2009-237361; WO2008/106034 and WO2009/029198; and Japanese Unexamined Patent Publication (KOKAI) Nos. 2010-256895, 2010-134424, and 2010-102234 for details on the steps of manufacturing a polarizing lens. An orientation layer is desirably formed between the lens substrate and the polarizing layer to uniformly orient a dichroic dye contained in the polarizing layer and achieve good polarizing performance. Reference can be made to the above-cited publications for details on the orientation layer. The above-cited publications are expressly incorporated herein by reference in their entirety.

The steps of processing a semifinished lens having the above acrylic coating on the outermost layer on the optical surface side into a finished lens to obtain an eyeglass lens will be described next.

The non-optical surface can be of any shape, such as convex, planar, or concave. It is usually concave in a semifinished lens. The non-optical surface can be polished with a known polishing jig, such as a polishing member having a convex portion comprised of an elastic material or a polishing plate made of metal. In the course of pressing a polishing member having a convex portion comprised of an elastic material down on a surface being polished, the elastic polishing member deforms somewhat so that polishing can be conducted even when the convex shape of the polishing jig does not perfectly correspond to the concave surface shape of the surface being polished. Accordingly, the number of items that a single polishing member can handle increases. This is advantageous in that the number of polishing jigs that must be prepared can be greatly reduced relative to the method employing a polishing plate made of metal.

A polishing member having a convex portion comprised of an elastic material in which the entire convex portion is comprised of an elastic material can be employed, or a polishing member in which the convex portion is a balloon member having a hollow interior (a hollow structure) that is capable of conducting polishing while feeding a fluid into the hollow interior to expand the balloon member can be employed. The latter polishing member is advantageous in that shape precision is enhanced by controlling the polishing conditions by means of the pressure that is applied with the fluid.

An elastic material having the properties of an elastic body and having a hardness of about 5 to 70 as defined by JIS k 6253 (Durometer type A or E) is desirable. Specific examples are natural rubber, styrene butadiene rubber (SBR), silicon rubber, and other synthetic rubbers. A balloon member in which the thickness of the elastic member portion is about 1 to 10 mm is suitable. Normally, compressed air, nitrogen, or a liquid such as water is used as the fluid that is fed into the balloon member. For example, reference can be made to paragraphs [0033] to [0037] of Japanese Unexamined Patent Publication (KOKAI) No. 2004-261954, paragraphs [0036] to of Japanese Unexamined Patent Publication (KOKAI) No. 2008-183714, and the like for the specific structure of a polishing jig containing a balloon member. The above-cited publications are expressly incorporated herein by reference in their entirety.

During polishing, a polishing pad is usually positioned on the convex portion of the polishing jig. The polishing pad plays the roles of supporting the abrasive and enhancing polishing efficiency. The polishing pad is not specifically limited. For example, those made of materials such as foam polyurethane, felt, nonwoven fabric, cloth of fibers such as wool, and synthetic resin can be employed. Reference can be made to paragraph [0034] of Japanese Unexamined Patent Publication (KOKAI) No. 2004-261954; paragraphs [0026] to [0027] and [0058] to [0061] of Japanese Unexamined Patent Publication (KOKAI) No. 2008-183714; and the like, for example, for shapes and methods of arranging polishing pads.

During polishing, the surface being polished (non-optical surface) is usually polished by positioning the polishing pad on the polishing jig, pressing the polishing jig against the surface being polished, and displacing (sliding) the two surfaces against each other. An abrasive is usually fed between the polishing jig and the surface being polished. The commercial slurries that are commonly employed in polishing can be employed as the abrasive. A slurry that has been prepared by dispersing abrasive polishing grains such as alumina or diamond powder in water or an aqueous solvent can be employed.

During polishing, the polishing jig and the semifinished lens being polished can be displaced in the same manner as in an ordinary polishing step. It is desirable for the polishing jig to be pressed against the surface being polished (non-optical surface), for the polishing jig to be made to undergo a swiveling, revolving motion, and for the semifinished lens to be moved back and forth to effect polishing by causing the surface being polished to follow a polishing path that differs slightly each time around in a non-orbital polishing path.

An example of a polishing device capable of the above operation will be described based on the drawings.

FIG. 1 is a schematic structural diagram of a polishing device that can be employed in the present invention.

In the figure, a polishing device, denoted overall by the numeral 30, is equipped with a device main body 32 that is positioned on the floor; an arm 34 disposed on device main body 32 so as to move freely in a right-left direction (the direction of arrow X) in the surface of the paper and disposed in freely rotating fashion in a direction (the direction of arrow AB) perpendicular to the surface of the paper about a horizontal axis 33; a driving device, not shown, that displaces arm 34 back and forth in a right-left direction and turns it in a direction perpendicular to the surface of the paper; a lens mounting member 36, positioned on arm 34 and holding a semifinished lens (also referred to simply as a "lens" hereinafter) through a block jig 37; a rocking device 38, disposed on device main body 32 at a position beneath lens mounting member 36, and that is caused to undergo a swiveling, revolving motion (without rotating) about a vertical axis K by a drive device, not shown; and the like.

Figure 2:
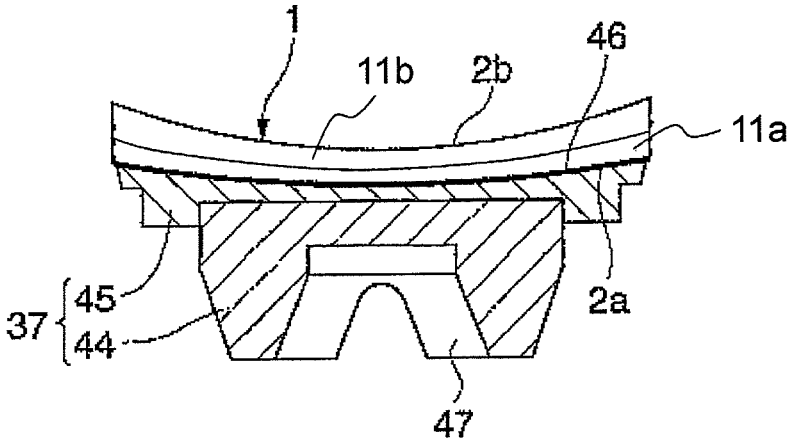
FIG. 2 is a sectional view of a semifinished lens to be polished that has been mounted on a block jig.

FIG. 2 is a sectional view of a lens 1 secured on block jig 37. In lens 1, an acrylic coating 11*a* is present on the optical surface of a lens substrate 11*b*. Non-optical surface 2*b* has been machined in advance to a prescribed surface shape with a curve generator or the like by implementing three-dimensional NC controls. It is the surface that is to be polished. A scratch-preventing protective film 46 is adhered through an adhesive layer of the film to the outermost surface 2*a* of acrylic coating 11*a*.

Adhesive tape having an adhesive layer on a substrate film, for example, can be employed as protective film 46. Such an adhesive tape can be fabricated by known methods or obtained as a commercial product. The adhesive layer can be formed of an acrylic adhesive, a rubber-based adhesive, or the like. Of these, a protective film having an adhesive layer formed of an acrylic adhesive (an acrylic adhesive layer) is a desirable protective film in the present invention. That is because the adhesion between an acrylic coating and a protective film can be further strengthened due to the good compatibility with acrylic coatings. Reference can be made to paragraphs [0010] to [0013] in Japanese Patent No. 3935619, which is expressly incorporated herein by reference in its entirety, for the adhesive components of acrylic adhesive layers. The thickness of the adhesive layer, although not specifically limited, is normally about 10 to 40 Reference can be made to the description in above-cited Japanese Patent 3935619 for other details regarding protective films having adhesive layers.

In FIG. 2, block jig 37 holding lens 1 is comprised of a metal (tool steel or the like) lens holder unit 44, and an adhesive 45 attaching lens holder unit 44 to lens 1. On the back surface side of lens holder unit 44 is formed a fitting concave member 47 that fits over lens mounting member 36. Fitting concave member 47 fits in a specific direction. Low-melting-point alloys (such as alloys of Bi, Pb, Sn, In, and Ga with melting points of about 49° C.) are usually employed as adhesive 45. A device called a layout blocker, made by LOH, can be employed to attach lens 1 to lens holder unit 44 by means of adhesive 45. Lens holder units 44 of varying sizes can be employed based on the degree of power and outer diameter of lens 1 and the curvature of convex surface 2*a*.

Figure 3:
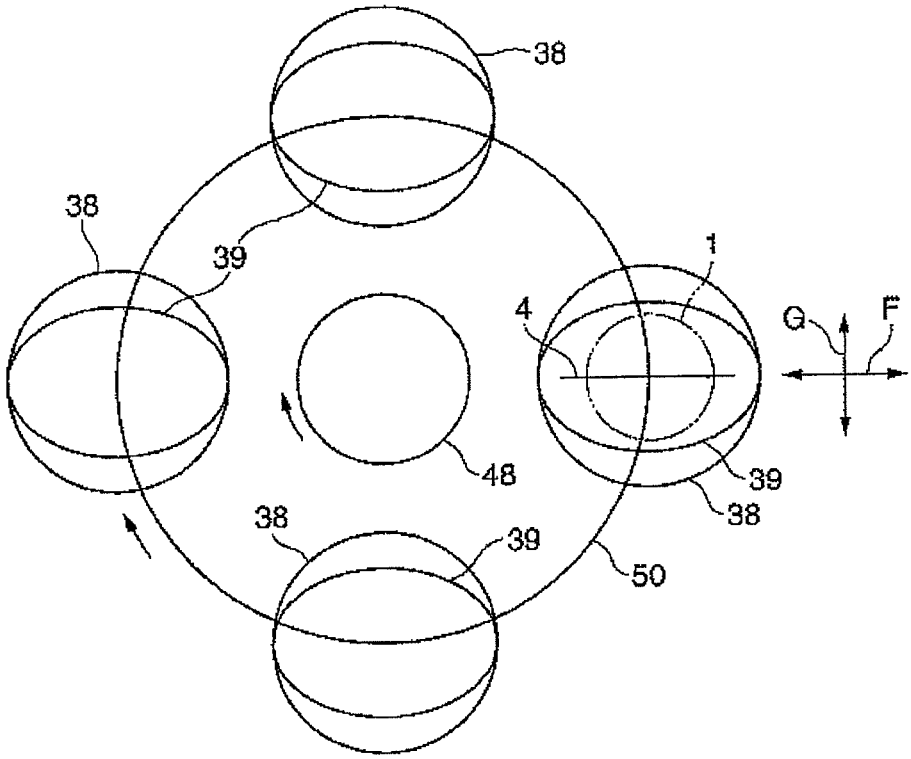
FIG. 3 is a descriptive drawing of the swiveling, revolving motion of a rocking device and polishing jig.
Figure 4:
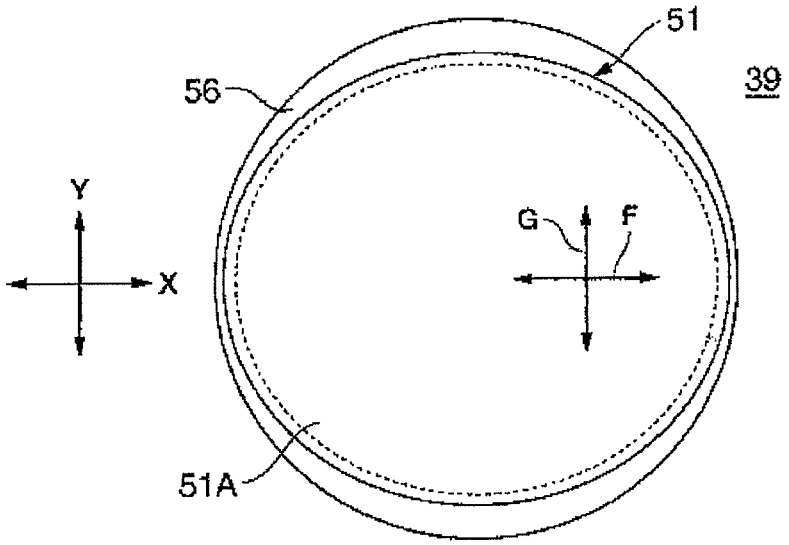
FIG. 4 is a plan view of an example of a polishing jig.
Figure 5:
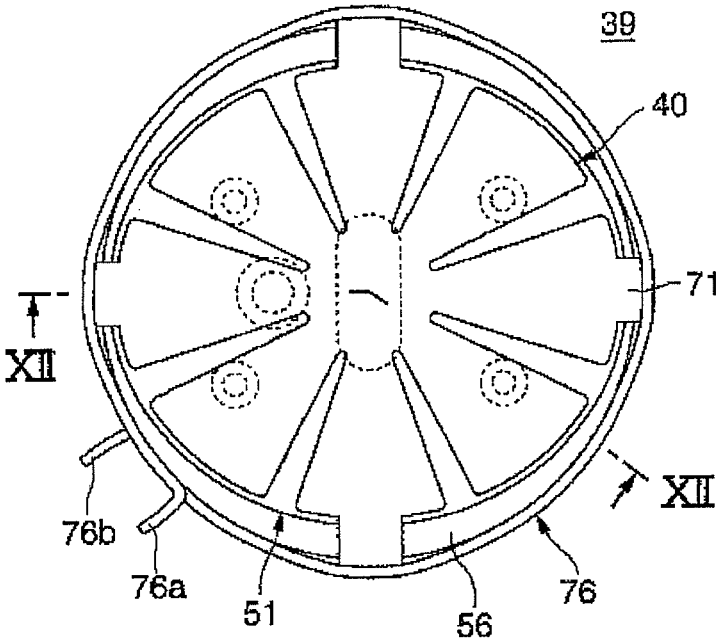
FIG. 5 is a plan view of a polishing pad mounted on the polishing jig shown in FIG. 4.
Figure 6:
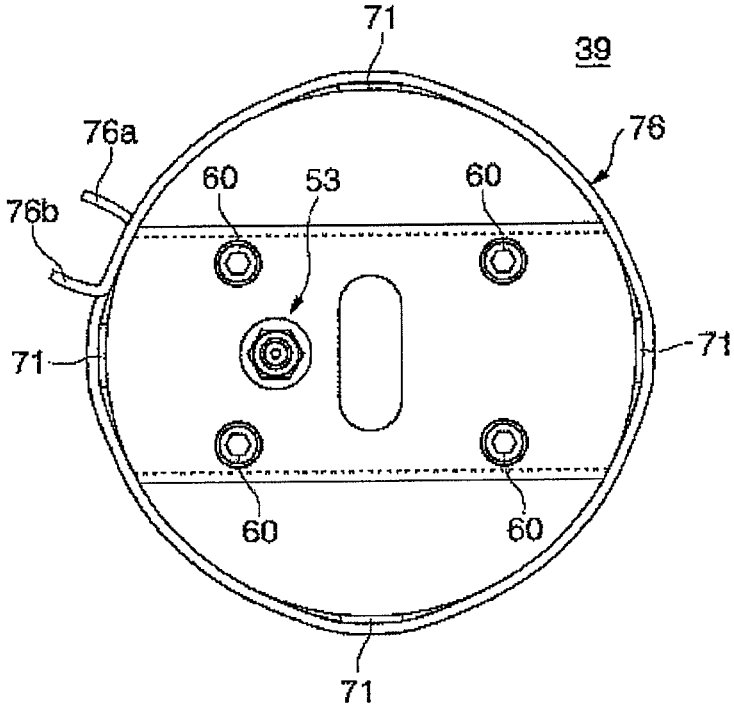
FIG. 6 is a bottom view of an example of a polishing jig.
Figure 7:
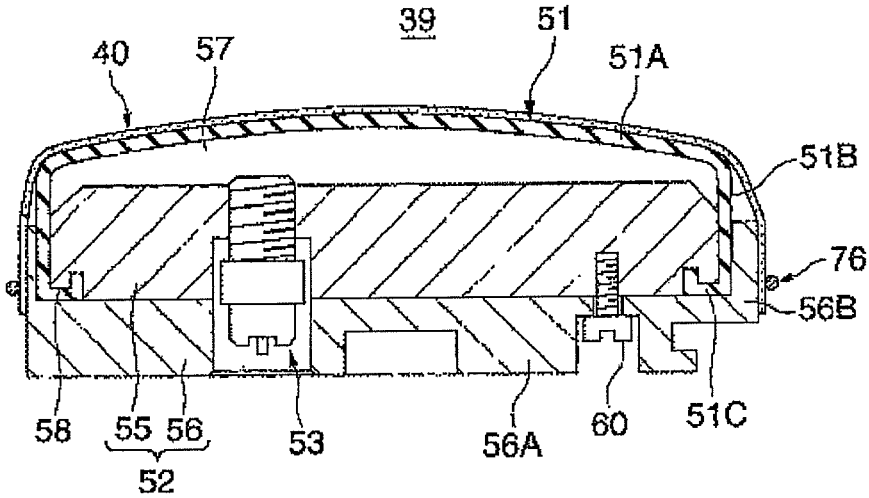
FIG. 7 is a section view along section line XII-XII in FIG. 5.

In FIG. 3, rocking devices 38 are mounted at a desired angle (a) of incline in a vertical direction on the tops of vertical revolving shafts 21, with polishing jigs 39 disposed in a detachable manner on the top surfaces thereof. Revolving shaft 48 turns about its axis during polishing. Rocking device 38 is configured so as to undergo swiveling, revolving motion about the axis of revolving shaft 48 when revolving shaft 48 turns. The angle of incline a of rocking device 38 relative to revolving shaft 48 is 5°, for example. FIG. 3 shows the path 50 of the swiveling, revolving motion of rocking device 38 and polishing jig 39. Rocking device 38 simply revolves around revolving shaft 48 in a swiveling, revolving motion, without rotating.

In FIGS. 4 to 7, polishing jig 39 is comprised of a balloon member 51 that opens downward and is formed in the shape of a cup out of an elastic material; a securing member 52 that plugs the opening in the bottom of balloon member 51 and keeps the interior airtight; and a valve 53 that feeds compressed air into the interior of balloon member 51.

Balloon member 51 is comprised of a dome member 51A; a cylinder member 51B that is approximately ellipsoid in shape, running integrally and extending downward from the outer perimeter of dome member 51A; and an inward flange 51C in the form of a ring running integrally along the lower edge of cylinder member 51B.

Securing member 52 is comprised of two members in the form of an inner securing member 55 and an outer securing member 56. These grip inward flange 51C of balloon member 51 from the inside and outside, sealing the bottom opening of balloon member 51 in airtight fashion. Thus, an airtight space 57 is formed within balloon member 51. Inner securing member 55 is comprised of an ellipsoid plate of approximately the same size as the inside shape of cylinder member 51B of balloon member 51, with an annular groove 58, into which inner flange 51C fits, formed in the outer circumference portion of the bottom thereof.

Outer securing member 56 is formed in the shape of a cup opening upward, and is comprised of a disk-shaped bottom plate 56A, and a cylindrical member 56B that integrally protrudes upward along the outer circumference of bottom plate 56A. The above inner securing jig 55 inserts with cylinder member 51B of balloon member 51 into cylindrical member 56B. The external shape of cylinder member 56B is round, and the internal shape thereof is ellipsoid and of about the same size as the external shape of cylinder member 51B of balloon member 51. Once inner securing member 55 has been integrally joined with multiple setscrews 60, outer securing member 56 is mounted on the upper surface of rocking device 38 with the reference axis direction of balloon member 51 (the direction of arrow F in FIG. 3) aligned with the direction of back and forth motion (direction X in FIG. 1) of arm 34, which is the reference axis direction of the surface being polished 2*b*.

Valve 53, a check valve, is mounted on inner securing member 55.

When compressed air is fed through the valve 53 into the airtight space 57 in the dome member 51, dome member 51A expands upward, forming a tonic surface in which the average curvature of the cross section containing the center axis of dome member 51A is maximal in the minor axis direction (the direction of arrow Gin FIG. 5) and is minimal in the major axis direction (the direction of arrow F). In that case, the curvature of dome member 51A varies in a manner corresponding to the center height (vertex height) of dome member 51A, so the height of the center of the dome can measured with a suitable device and adjusted to achieve a desired curvature of dome member 51A.

Polishing pad 40 is mounted in detachable fashion on polishing jig 39 by means of fastening member 76. The fastening member 76 is a wire spring of suitable diameter that is plastically deformed in a ring shape with two overlapping end portions. In its undeformed state, it has a smaller diameter than the outer diameter of the outer securing member 56, with two end portions 76*a* and 76*b* bent outward at approximately right angles.

To mount the polishing pad 40 on polishing jig 39, compressed air is first supplied to cause dome member 51A of balloon member 51 to expand it to a prescribed dome shape, after which polishing portion 70 of polishing pad 40 is installed thereon. Next, the two ends 76*a* and 76*b* of fastening member 76 are gripped between the finger tips, and the space between them is narrowed by countering the elastic force, thereby increasing the diameter of fastening member 76. In that state, fastening member 76 is placed over securing pieces 71 of polishing pad 40, and securing pieces 71 are bent downward until they contact the outer circumference of outer securing member 56. The finger tips are removed from the two ends 76*a* and 76*b*, causing fastening member 76 to return to its original shape to fasten securing pieces 71 to the outer circumference of outer securing member 56 and thus concluding the mounting of polishing pad 40.

Lens 1 can be polished in a polishing device 30 thus configured by the following procedure.

First, lens 1 is secured on block jig 37 on lens mounting member 36 of arm 34. Next, polishing jig 39 on which polishing pad 40 has been mounted is positioned on the upper surface of rocking device 38. In the course of mounting lens 1 on lens mounting member 36, mounting is desirably conducted so that the reference axis direction of surface being polished 2*b* of lens 1 is aligned with the direction of back and forth movement (the direction of arrow X in FIG. 1) of arm 34. In the course of positioning polishing jig 39 on rocking device 38, positioning is desirably conducted so that the reference axis direction (direction F) of balloon member 51 is aligned with the direction of back and forth movement (the direction of arrow X in FIG. 1) of arm 34.

Figure 8:
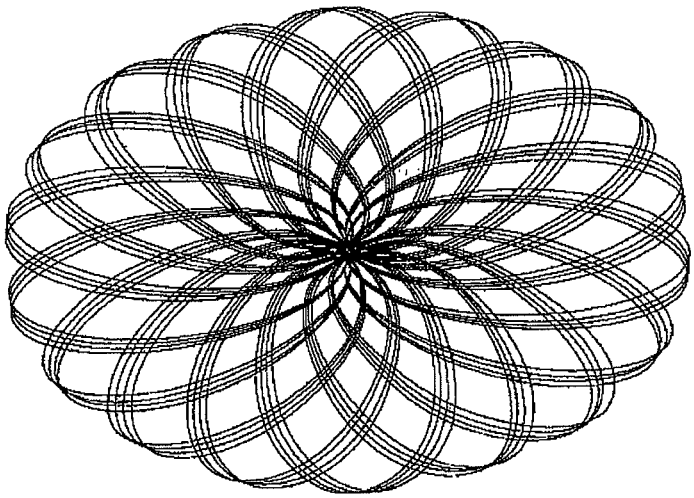
FIG. 8 is drawing showing an example of the movement path of a lens being polished.

Once lens 1 has been mounted on lens mounting member 36, elevating and lowering device 41 lowers lens 1, pressing non-optical surface 2*b* against the surface of polishing pad 40. In this state, abrasive is fed to the surface of polishing pad 40, arm 34 is moved back and forth to the left and right and moved in a front and back motion about axis 33. Such movement of arm 34 causes lens 1 to follow the displacement path shown in FIG. 8.

Further, revolving shaft 21 is revolved to cause rocking device 38 to undergo the swiveling and revolving motion shown in FIG. 3. Such movement of lens 1 and rocking device 38 causes non-optical surface 2*b* of lens 1 to be polished by the polishing pad 40 and the abrasive in a polishing path that is non-orbital and changes slightly each time, thereby finishing it into an optical surface of desired surface shape.

The polishing of the non-optical surface can be done in a single polishing stage, or in two or more polishing stages. A non-optical surface that has been cut with a curve generator will sometimes contain processing discontinuities caused by NC control backlashes and the like. In such cases, it is necessary to remove the processing discontinuities by polishing to obtain an optical surface. Accordingly, in that case, polishing of the non-optical surface is desirably conducted in two stages of polishing consisting of rough polishing and finish polishing. For example, in the rough polishing, abrasive polishing grains with an average particle diameter of 1.6 to 1.8 μm can be employed and the temperature can be kept to 8 to 14° C. The polishing time can be 2 to 6 minutes, the polishing pressure can be 5 to 400 millibars, and the rotational speed can be 400 to 1,000 rpm.

Then, in the finish polishing, for example, abrasive polishing grains with an average particle diameter of about 0.8 μm can be employed, the polishing time can be kept to from about 30 seconds to 1 minute, the polishing pressure can be 5 to 400 millibars, and the rotational speed can be 400 to 1,000 rpm. Changing the polishing conditions to conduct polishing in this manner makes it possible to reliably remove processing discontinuities.

Following the above polishing, the lens is subjected to optional post-processing such as washing and can be shipped as a finished lens. It is also possible to use known methods to form functional films such as water-repellent films and anti-reflective films on the acrylic coating and/or the optical surface that has been created and ship a finished lens.

The present invention makes it possible to polish a semi-finished lens having an acrylic coating on the outermost surface of the optical surface side thereof while stably secured on a block jig, and thus makes it possible to readily create an optical surface of desired surface shape without polishing failure.

EXAMPLES

The present invention will be further described through Examples below. However, the present invention is not limited to the embodiments shown in the Examples.

Example 1

1. Preparation of Acrylic Coating Liquid

To 1,800 mass parts of propylene glycol monomethyl ether (PGM) were admixed 900 mass parts of acrylate compound (ε-caprolactone-added acrylate of dipentaerythritol (Kayarad DPCA-60, made by Nippon Kayaku)), 333 mass parts of organosilica sol (MIBK-ST made by Nissan Chemical Industries, Ltd., solid component: 100 mass parts, content of silica colloid particles in solid component: 10 mass %), and 45 mass parts of photopolymerization initiator (Irgacure 184, made by Ciba Japan Vision) to prepare an acrylic coating liquid for forming a hard coat layer.

2. Formation of Hard Coat Layer

The acrylic coating liquid prepared in 1. above was applied by spin coating (1,000 rpm held for 30 s) to the convex surface of a polyurethane-urea lens (Phoenix, name of product made by HOYA Corporation, 75 mm diameter) with a convex surface (optical surface) on one side and a concave surface on the other obtained by casting polymerization. Following the coating, curing was conducted at a UV radiation level of 1,200 mJ/cm$^2$ with a UV radiation irradiating device to form a hard coat layer 3.9 μm in thickness.

3. Measurement of the Contact Angle of the Surface of the Hard Coat Layer

The contact angle of the surface of the hard coat layer formed in 2. above relative to water as measured (measurement environment: temperature 23.4° C., humidity 38%) with a contact angle meter (contact angle meter, Model CA-D) made by Kyowa Interface Science was 60°.

4. Mechanical Processing of Concave Surface

The concave surface of the lens following the processing of 2. above was cut to a prescribed surface shape with a curve generator using three-dimensional NC controls.

5. Polishing of Concave Surface

A commercial protective film (made by VIGteQnos) with an adhesive layer about 30 μm in thickness comprised of acrylic adhesive laminated on a polyolefin film about 100 μm in thickness was provided, and adhered by means of the adhesive layer to the convex surface of the lens that was ground in 4. above. Subsequently, the lens was secured to a block jig as shown in FIG. 2. An alloy blocker called layout blocker made by LOH was employed to secure the lens.

Next, while secured to the block jig, the lens was mounted on the polishing device shown in FIG. 1 and polished according to the above-described procedure with the polishing jig shown in FIGS. 4 to 7 for a polishing period of 5 minutes at a polishing pressure of 200 millibars at a rotational speed of 530 rpm using a slurry, obtained by dispersing alumina with an average particle diameter of 0.8 μm in water, as abrasive. Wool polishing pads about 2 mm thick were employed. Styrene butadiene rubber (SBR) about 3 mm in thickness with a hardness as defined by JIS k 6253 (durometer type E) of 50 and an outer diameter of 90 mm was employed as the balloon material.

6. Evaluation of the State of Adhesion of the Protective Film Following Polishing Following the polishing of 5. above, the lens was removed from the block jig and the state of adhesion of the protective film and surface to which it had been adhered was visually observed. When there was no lifting or separation of the protective film in the center and the area in which lifting and separation was observed was about equal to or less than 40%, an evaluation of "○" was made. When the area in which lifting and separation of the protective film was observed, including the center portion, was about equal to or more than 60%, an evaluation of "X" was made.

7. Evaluation of Adhesive Remaining after Separation of Protective Film

A Little Star tension and compression tester made by Tokyo Keiki, Inc. (in which a 500 N load cell had been mounted) was used to peel the protective film away from the surface on which it had been applied following the evaluation of 6. above at a tension rate of 30 mm/minute. The surface of the hard coat layer was visually observed following removal of the protective film to determine the amount of adhesive remaining. When no remaining adhesive was visually observed, an evaluation of "0" was made. When observed, an evaluation of "X" was made.

Examples 2 and 3, Comparative Example 1

With the exceptions that the formula of the acrylic coating liquid and the thickness of the hard coat layer were varied as indicated in Table 1, processing and evaluation were conducted in the same manner as in Example 1.

Example 4

With the exception that the hard coat layer was formed on the surface of a polarizing layer after forming the polarizing layer by the method set forth below on the convex surface of a lens, processing and evaluation were conducted in the same manner as in Example 2.

(1) Formation of Orientation Layer

An $SiO_2$ film was formed to a thickness of 0.2 μm by the vacuum vapor deposition method on the convex surface of a lens.

The $SiO_2$ film that had been formed was subjected to a uniaxial polishing treatment for 30 s under conditions of a rotational speed of 350 rpm and a polishing pressure of 50 g/cm$^2$ using an abrasive-containing urethane foam (abrasive: product name POLIPLA203A made by Fujimi Inc., $Al_2O_3$ particles with an average particle diameter of 0.8 μm; urethane foam: nearly identical in shape to the curvature of the concave surface of the above lens). The lens that had been subjected to the polishing treatment was washed with pure water and dried.

(2) Formation of Polarizing Layer

The lens was dried, after which 2 to 3 g of an approximately 5 mass % aqueous solution of dichroic dye (product name "Varilight Solution 2S," made by Sterling Optics, Inc.) was used to form a polarizing layer by spin coating on the polished surface. In the spin coating, the dye aqueous solution was fed at a rotational speed of 300 rpm held for 8 s, followed by a rotational speed of 400 rpm held for 45 s and 1,000 rpm held for 12 s. Following the spin coating, a pH 3.5 aqueous solution with an iron chloride concentration of 0.15 M and a calcium hydroxide concentration of 0.2 M was prepared. The lens obtained above was immersed in this aqueous solution for about 30 s, after which it was withdrawn and thoroughly rinsed in pure water. This process rendered the originally water-soluble dye insoluble.

Subsequently, the lens was immersed for 15 minutes in a 10 mass % aqueous solution of γ-aminopropyltriethoxysilane, then rinsed three times in pure water, and heat cured for 30 minutes at 85° C. Following cooling, the lens was immersed for 30 minutes in a 2 mass % aqueous solution of γ-glycidoxypropyltrimethoxysilane in air, heat cured for 30 minutes in a 100° C. furnace, and cooled following curing to form a dye protecting layer (immobilization processing).

Following the above processing, the thickness of the polarizing layer that had been formed was about 1 μm.

Reference Example 1

With the exception that the protective film was directly adhered to the convex surface of the lens without forming a hard coat layer, processing and evaluation were conducted in the same manner as in Example 1.

Although no securing failure was exhibited by the lenses during polishing in Examples 1 to 4 or Reference Example 1, the phenomenon of the lenses being variously unstable during polishing was observed in Comparative Example 1.

Table 1 below gives the details of Examples 1 to 4, Comparative Example 1, and Reference Example 1 set forth above.

All of the samples indicated in Table 1 readily permitted peeling away of the protective film without the observation of residual adhesive on the surface on which the protective film had been adhered once the protective film had been separated. However, Comparative Example 1, which exhibited securing failure during polishing, received an evaluation result of "X" for the state of adhesion of the protective film following polishing, as shown in Table 1, and lifting and separation of the protective film were observed over a broad range. By contrast, Examples 1 to 4, in which stable polishing was possible without securing failure, received evaluation results of "○". Accordingly, the securing failure in Comparative Example 1 could be attributed to the fact that there was inadequate adhesion between the protective film and the surface on which the protective film had been adhered, and to the fact that adhesion decreased when the contact angle relative to water of the hard coat layer surface to which the protective film had been adhered exceeded 90°. In Examples 1 to 4, the addition of silica colloidal particles to the acrylic coating liquid employed to form the hard coat layer lowered the contact angle (increased the hydrophilic property) of the hard coat layer surface to close to the value of the lens surface, and was thus thought to contribute to enhancing adhesion.

The above results show that, in a semifinished lens in which an acrylic coating has been formed on an optical surface of a lens substrate for the purpose of protection of the optical surface and the like, forming an acrylic coating with a contact angle relative to water of equal to or less than 90° permits stable polishing to create an optical surface.

The present invention is useful in the field of manufacturing eyeglass lenses.

What is claimed is:

1. A method of manufacturing an eyeglass lens, which comprises a step of conducting polishing processing of a non-optical surface of a semifinished lens, one surface of which is an optical surface and the other surface of which is the non-optical surface, to create an optical surface, wherein the semifinished lens comprises an acrylic coating on an optical surface of a lens substrate, a surface of the acrylic coating having a contact angle relative to water of equal to or less than 90°,

TABLE 1

| | | Ex. 1 | Ex. 2 | Ex. 3 | Ex. 4 | Comp. Ex. 1 | Ref. Ex. 1 |
|---|---|---|---|---|---|---|---|
| Presence or absence of polarizing layer | | None | None | None | Present | None | None |
| Composition of acrylic coating | Acrylate compound (mass parts) | 900 | 600 | 400 | 600 | 1000 | — |
| | Organosilica sol (mass parts/ converted based on solid component) | 100 | 400 | 600 | 400 | 0 | — |
| | Content of silica colloidal particles in the solid component of organosilica sol (mass %) | 10 | 40 | 60 | 40 | — | — |
| | PGM (mass parts) | 1800 | 1300 | 600 | 1300 | 2000 | — |
| | Photopolymerization initiator (mass parts) | 45 | 30 | 20 | 30 | 50 | |
| Thickness of hard coat layer (μm) | | 3.9 | 3.5 | 2.6 | 3.6 | 2.2 | — |
| Contact angle of the surface on which protective film had been adhered (°) | | 60 | 66 | 65 | 64 | 95 | 65 |
| Evaluation results | State of adhesion of protective film following polishing | ○ | ○ | ○ | ○ | x | ○ |
| | Adhesive remaining after separation of protective film | ○ | ○ | ○ | ○ | ○ | ○ |

prior to the polishing processing, adhering a protective film through an adhesive layer of the film to the surface of the acrylic coating, and conducting the polishing processing by polishing a non-optical surface of the lens substrate in a state where the protective film surface is secured in a block jig.

2. The method of manufacturing according to claim 1, wherein the acrylic coating is a coating layer formed by curing a coating film containing an acrylate compound and inorganic oxide particles.

3. The method of manufacturing according to claim 2, wherein the inorganic oxide particles are silica colloidal particles.

4. The method of manufacturing according to claim 1, wherein the adhesive layer is comprised of acrylic adhesive.

5. The method of manufacturing according to claim 1, wherein the semifinished lens comprises a polarizing layer between the lens substrate and the acrylic coating.

* * * * *